US006502431B1

(12) United States Patent
Yamano et al.

(10) Patent No.: US 6,502,431 B1
(45) Date of Patent: Jan. 7, 2003

(54) WASHING MACHINE AND METHOD OF BREAKING UP SAME

(75) Inventors: Atsuo Yamano, Tenri (JP); Hideo Okada, Uda-Gun (JP); Yuuji Yokosawa, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 177 days.

(21) Appl. No.: 09/629,946

(22) Filed: Aug. 1, 2000

(30) Foreign Application Priority Data

| | | |
|---|---|---|
| Aug. 2, 1999 | (JP) | 11-218333 |
| Aug. 2, 1999 | (JP) | 11-218334 |
| Aug. 2, 1999 | (JP) | 11-218394 |
| Aug. 27, 1999 | (JP) | 11-241225 |
| Jul. 19, 2000 | (JP) | 2000-218566 |

(51) Int. Cl.[7] ..... D06F 39/08
(52) U.S. Cl. ..... 68/3 R; 68/23.5; 68/207
(58) Field of Search ..... 68/23.5, 207, 184, 68/181 R, 183, 3 R

(56) References Cited

U.S. PATENT DOCUMENTS 4,535,610 A * 8/1985 Fey et al.
4,680,948 A * 7/1987 Rummel et al.

FOREIGN PATENT DOCUMENTS

| | | | |
|---|---|---|---|
| GB | 2081311 | * | 2/1992 |
| JP | 60-137393 | * | 7/1985 |
| JP | 60-145192 | * | 7/1985 |
| JP | 60-22089 | * | 11/1985 |
| JP | 60-222088 | * | 11/1985 |
| JP | 2-55096 | * | 2/1990 |
| JP | 2-55097 | * | 2/1990 |
| JP | 2-234796 | * | 9/1990 |
| JP | 2-237598 | * | 9/1990 |
| JP | 2-243195 | * | 9/1990 |
| JP | 2-243196 | * | 9/1990 |
| JP | 3-57496 | * | 3/1991 |
| JP | 3-178694 | * | 8/1991 |

* cited by examiner

*Primary Examiner*—Frankie L. Stinson
(74) *Attorney, Agent, or Firm*—Nixon & Vanderhye, P.C.

(57) ABSTRACT

A washing machine that facilitates and simplifies the breaking up of the washing machine to recycle or re-use the components thereof and the method of breaking up the washing machine. A plurality of upper receptors are provided in the upper inside of the housing. A plurality of lower receptors are provided in the lower outside of the washing-tub assembly. The upper and lower receptors are linked by rolls to constitute a suspension mechanism. Each rod has an upper support and a lower support at the upper and lower ends, both supports are larger than the rod in diameter. With the upper supports engaged with the upper receptors and the lower supports with the lower receptors, the washing-tub assembly is suspended within the housing. A recess is formed on the top of upper receptor. The bottom of the recess is provided with a hole and a slit that is a path to the hole. The diameter of the hole and the width of the slit are set in such a way that the rod is allowed to pass but the upper support is not allowed to. A retainer is provided at the slit. This retainer can selectively take either one of two positions—the first position in which it retains said rod in said hole, and the second position in which it allows the rod to get into or get out of said hole through said slit. By shifting the retainer from the first position to the second position, the rod can be removed from the first receptor without raising the washing-tub assembly.

2 Claims, 23 Drawing Sheets

WASHING MACHINE AND METHOD OF BREAKING UP SAME

BACKGROUND OF THE INVENTION

1. Field of the Invention

The present invention relates to a washing machine and more particularly to the construction of the washing machine that facilitates and simplifies the breaking up of the washing machine to recycle or re-use the components thereof and the method of breaking up, the washing machine.

2. Description of the Prior Art

An electric washing machine of the following construction is well known. That is, a washing-tub assembly is suspended by a suspension mechanism and is able to swing in a box-like housing. The washing-tub assembly includes a spin tub. for squeezing—which also serves as a washing tub—and a water tub. The spin tub and the water tub are both cylindrical in shape with an open upper end and a closed bottom, and are disposed concentric with each other with the spin tub being inside of the water tub. The spin tub is provided with a number of holes or slits through which the water squeezed by centrifugal force is drained. The water tub has no holes or slits unlike the spin tub and is so designed to hold cleansing solution or rinse water. A balancer is mounted on the upper part of the spin tub to keep down the vibration of the spin tub during the squeezing step. A pulsator is provided at the inner bottom of the spin tub to stir the cleansing solution or rinse water. A motor is attached to the outer bottom of the water tub via a mounting plate. The motor turns the pulsator alone or together with the spin tub. Only the pulsator is turned during a washing/rinsing mode, while the pulsator and the spin tub are turned together during a squeezing mode. The bottom of the water tub water tub is provided with a drain valve to drain the cleansing solution and rinse water. A top cover is mounted on top of the housing. The top cover is molded of a synthetic resin and at its center has an opening through which washings are thrown in or taken out. On the front portion (the side close to the operator) of the top cover, an operation panel and an operation control unit are provided, and on its rear portion (the side remote from the operator), such component parts as a water valve, a pouring case and a reactor are placed.

Recycling or re-use of the component parts of electric appliances is much talked about in the world of late. Some nations or regions have legislated or are going to legislate recycling acts. Electric washing machines are no exception. In view of the recent trends to recycling acts of the component parts, the washing machines have to be so designed that they are easy to break up and the components thereof can be sorted out without difficulty. However, the prior art washing machines are not of such a construction as to meet the recycling requirements. To cite some examples, the prior art washing machines have the following problems that hinder the breaking up work.

(a) To remove the suspension mechanism of the washing-tub assembly from the housing, it is necessary to lighten the load on the upper part of the suspension mechanism by raising the washing-tub assembly and then to detach the connecting parts of suspension mechanism by hand one by one. The washing-tub assembly is so heavy that this task needs two personnel, rather than one. In case the work has to be done by one person, he/she may need mechanical assistance.

(b) To remove the lower part of the suspension mechanism from the washing-tub assembly, the washing-tub assembly, too, has to be raised to lighten the load on the lower part of the suspension mechanism. Then the connecting parts of the suspension mechanism are detached by hand one by one. As in the case of removing the upper part of the suspension mechanism from the housing, this task needs two personnel. In case this task has to be done by one person, he/she may need mechanical assistance.

(c) The balancer is attached to the spin tub by many screws. It is a time-consuming job to remove all those screws before the balancer can be removed.

(d) The drain valve is bonded to the drain mouth with an adhesive and difficult to remove from the water tub. Even if the drain valve is successfully removed, the residual adhesive on the bonding area causes deterioration of the quality of the recycled resin.

(e) To retrieve synthetic resin from the top cover, many parts fixed on it have to be removed, and this is a time-consuming job. The top cover with the parts fixed thereon might be shredded to retrieve metals, but this scheme makes it very difficult to sort out resin materials.

SUMMARY OF THE INVENTION

It is a general object of the present invention to provide a washing machine of a new construction that solves aforementioned problems encountered in breaking up the prior art washing machines. It is a more specific object of the present invention to provide a washing machine in which the suspension mechanism to suspend and hold the washing-tub assembly within the housing is easy to remove from the housing. It is another object of the present invention to provide a washing machine of which the suspension mechanism is easy to remove from the washing-tub assembly. It is still another object of the present invention to provide a washing machine in which the balancer is easy to remove from the spin tub. It is a further object of the present invention to provide a washing machine in which the spin tub is easy to remove from the water tub and the resin to be recycled from the retrieved resin material remains good in quality. It is a still further object of the present invention to provide a washing machine in which the top cover is easy to break up and the retrieval of synthetic resins therefrom is also easy. It is still another object of the present invention to provide a method of breaking up the washing machine speedily.

To effect those objects, the following construction is adopted for the washing machine of the present invention. First, a plurality of upper receptors are provided at the upper inside of a housing. A plurality of lower receptors, which correspond with the upper ones, are provided at the lower outside of a washing-tub assembly. Each pair of upper and lower receptors are connected by a rod to constitute a suspension mechanism. Each rod has an upper support and a lower support, at its upper and lower ends respectively. The supports are larger than the rod in diameter. The upper support engages with the upper receptor and the lower support engages with the lower receptor, thereby suspending the washing-tub assembly in the housing. On the top of the upper receptor is formed a recess. At the bottom of the recess are provided a hole and a slit, which serves as a path to the hole. The diameter of the hole and the width of the slit are set at such a size that the rod can pass through while the upper support cannot. In an intermediate point of the slit, a retainer is provided. This retainer can take its first and second positions selectively. In the first position, the retainer holds the rod in the hole. In the second position, the retainer allows the rod to pass through the slit to fit into the hole or come out of the hole through the slit. By shifting the retainer from the first position to the second position, the rod can be removed from the upper receptor without lifting the washing-tub assembly.

The lower receptor is designed in such a way. It is formed in the shape of a cylinder with a closed top and an open bottom, and provided with a hole at the top and a slit expanding from the side to the top to serve as a path to the hole. The diameter of the hole and the width of the slit so measure that the rod can pass through while the lower support cannot. And the slit is provided in such a position that when the washing-tub assembly is lifted until the lower support comes out below the lower receptor, the rod swings automatically out of the lower receptor through the slit in the direction radial to the center of the washing-tub assembly. The joining point of the hole and the slit is so formed as not to hinder the rod motion induced by gravity. Because of this arrangement, the rod frees itself from the second receptor and the washing-tub assembly can be separated from the housing by merely lifting the washing-tub assembly.

A balancer is mounted on a spin tub in the following way. An annular groove to receive the top portion of the spin tub is provided on the bottom of the balancer. Protrusions are provided on one side—either on the underside of the balancer or at the top of the spin tub—and, recesses corresponding with the protrusions are provided on the other side. The balancer is mounted on the spin tub by fitting the top portion of the spin tub in said groove to engage the protrusions with the recesses. Since the turning force from the spin tub is delivered to the balancer through the protrusions and the recesses, a small number of screws are enough to retain the balancer in place against lifting force, and this leads to a substantial reduction of time needed for removing the screws in the breaking-up process unlike the prior-art balancer which is fixed by a large number of screws. In another arrangement, connecting fingers with claws or recesses at their tips extend downward from the balancer, and the top of the spin tub is provided with recesses or claws that engage with the claws or recesses of said connecting fingers. The balancer is mounted on the spin tub by fitting the top portion of the spin tub in the groove on the underside of the balancer to engage the claws or recesses of the connecting fingers with the recesses or claws on the spin tub side. This way, the balancer can be fixed on the spin tub without using any screws, which further shortens the time needed for separating the balancer.

A drain valve is connected to a drain mouth of a water tub in the following way. The drain valve is fixed on a plate for mounting a motor to be fixed on the underside of the water tub so that an inlet pipe is fit over the drain mouth. The inlet pipe is pressed by the mounting plate to force the inlet pipe around the drain mouth. If the mounting plate is separated from the water tub, the drain valve will also come off the drain mouth, leaving no adhesive.

A top cover is arranged in the following way. The front portion of the cover is provided with an operation panel and an operation control unit, while the rear portion thereof is provided with a parts unit formed by mounting at least a water valve and a pouring case on a base, and a rear cover to cover the parts unit. Since the parts positioned at the rear of the top cover can be removed as a parts unit in a lump, the synthetic resin of the top cover can be retrieved for recycling without much increasing the time for breaking-up work.

Meanwhile, the washing machine is so designed that it can be broken up in the following way. When breaking up a washing machine with a box-like housing inside which are found: a washing-tub assembly including a spin tub—which serves as a washing tub as well—and a water tub inside which the spin tub is disposed and can hold the cleansing solution or rinse water; a pulsator to stir the cleansing solution or rinse water within the spin tub; at the top of the spin tub, a ring-shaped balancer that keeps down vibration of the washing tub assembly during a squeezing step; on the underside of the water tub, a motor to turn the pulsator alone or the spin tub and pulsator together; at the top of the housing, a top cover; in the front portion of the top cover, an operation panel and an operation control unit; and in the rear portion of the top cover, a parts unit formed by mounting at least a water valve and a pouring case on a base, and a rear panel to cover the parts unit, the following steps are taken:

(a) separating the top cover, operation panel and operation control unit, parts unit and rear panel from the washing machine's mechanical compartment, which includes the housing and the washing-tub assembly, (b) separating the washing-tub assembly from the housing, (c) breaking up the washing-tub assembly into the pulsator, spin tub and water tub, (d) separating the balancer from the spin tub, and (e) removing the motor from the water tub. Thus, the respective component parts can be recycled by suitable techniques.

BRIEF DESCRIPTION OF THE DRAWINGS

These and other objects and features of the present invention will become clear to those skilled in the art from the following description, taken in conjunction with the preferred embodiments with reference to the accompanying drawings in which.

DESCRIPTION OF THE PREFERRED EMBODIMENTS

Figure 1:
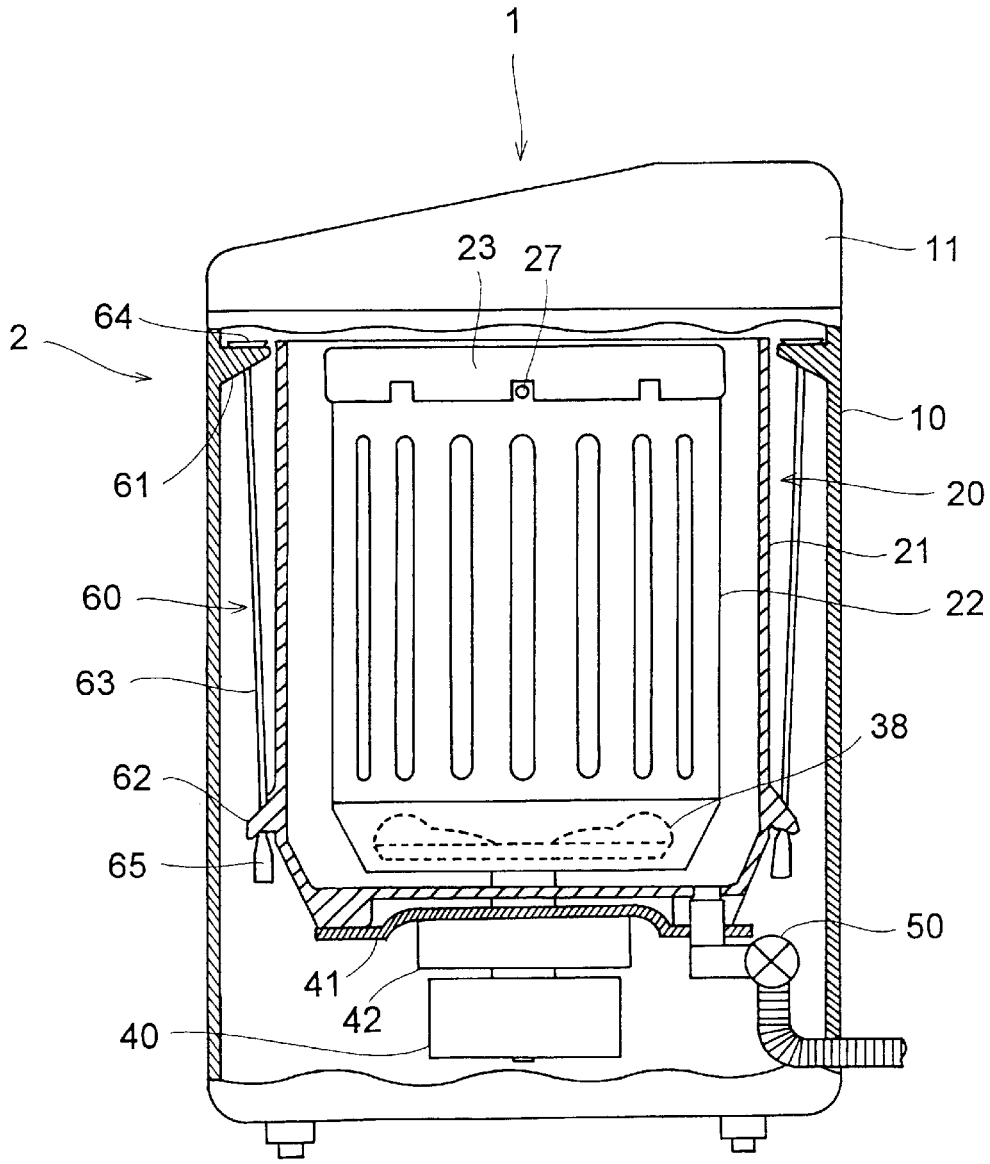
FIG. 1 is a vertical, sectional view of the essential part of a washing machine according to the present invention.
Figure 2:
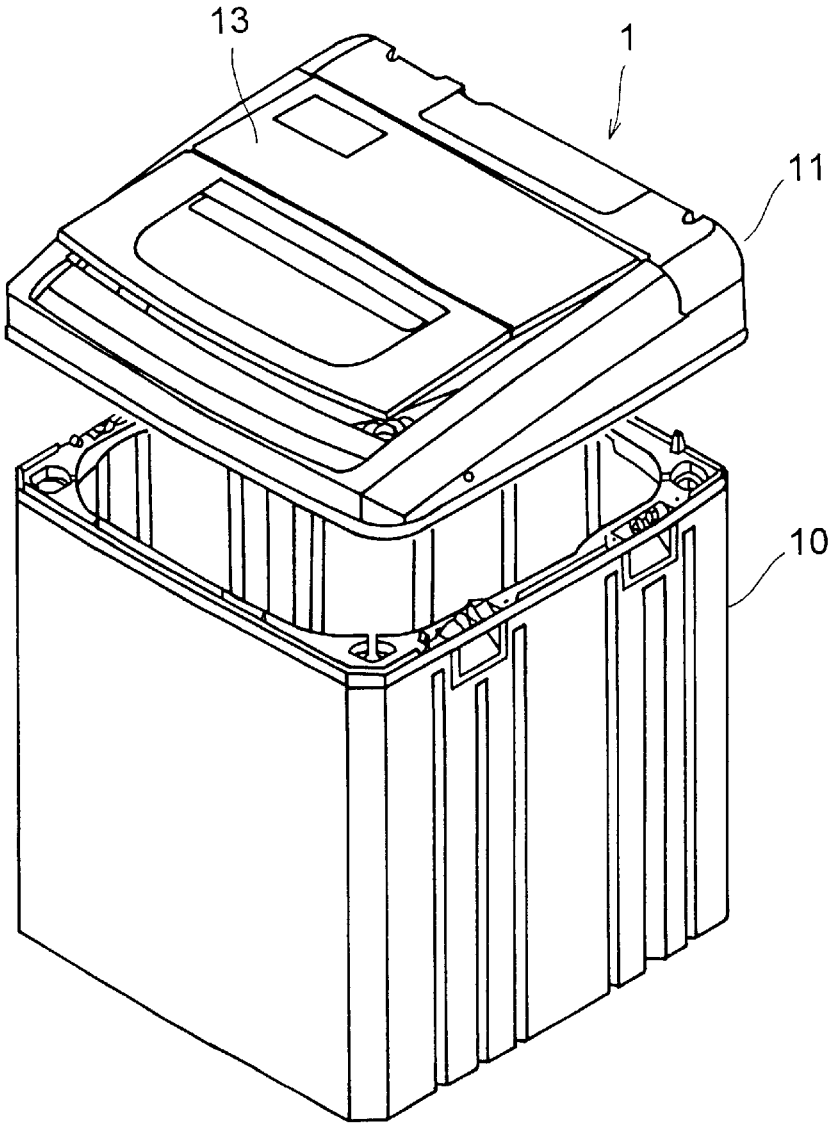
FIG. 2 is a perspective view of the; exterior components of the washing machine according to the present invention.

Referring now to the drawings for a more complete understanding of the invention, FIG. 1 shows the components inside the washing machine 1, while FIG. 2 shows the exterior components of washing machine 1. The reference numeral 10 indicates a box-like housing that is formed of steel plate and synthetic resin. The numeral 11 indicates the top cover of synthetic resin that is put at the top of the housing 10. The construction of the top cover 11 will be explained in detail later.

Inside the housing 10, there are found the following component parts. The numeral 20 indicates a washing-tub assembly, the numeral 40 a motor to be attached to the outer bottom of the washing-tub assembly 20, the numeral 50 a drain valve to drain the washing-tub assembly 20, the numeral 60 a suspension mechanism to suspend the washing-tub assembly 20 in the housing 10. The housing 10 and the aforesaid components therein constitute a mechanical compartment 2 of the washing machine.

The washing-tub assembly 20 has a water tub 21 and a spin tub 22, both of which are cylindrical in shape and have an open top and a closed bottom respectively. The water tub 21 and spin tub 22 are disposed concentrically with each other with the spin tub 22 inside. The spin tub 22 serves as a washing tub, too. The spin tub 22 is turned at a high speed to squeeze water out of wet washings by centrifugal force and is provided with a large number of holes or slits for drainage on the circumferential wall thereof. A balancer 23 is mounted on the edge of the top of the spin tub 22. The balancer 23 reduces the vibration of the spin tub 22 caused due to uneven distribution of washings during the squeezing step. The inner bottom of the spin tub 22 is provided with a pulsator 38 to stir the cleansing solution or rinse water.

The motor 40 is attached to the outer bottom of the water tub 21 via a mounting plate 41. The motor 40 turns the pulsator 38 alone or the spin tub 22 along with the pulsator 38 through a clutch mechanism 42 integrally combined thereto. The pulsator 38 alone is turned during a washing/rinsing mode, and the spin tub 22 and the pulsator 38 are turned during a squeezing mode.

Various ideas are incorporated in the mechanical compartment 2 of the washing machine to facilitate and simplify the breaking-up work. They will be described one by one in the following.

The suspension mechanism 60 includes four upper receptors 61 that protrude from four upper corners on the inside wall of the housing 10, four lower receptors 62 that protrude from the lower outside wall of the water tub 21 correspondingly to the upper receptors 61, and four rods 63 that link these upper and lower, receptors 61, 62. The rod 63 has at its upper and lower ends an upper support 64 and a lower support 65 that are each larger than the rod 63 in diameter. The upper support 64 is shaped like a flange while the lower support 65 has a cylindrical shape. These supports may be integrally formed with the rod 63 or may be formed separately and fastened to the rod 63.

Figure 26:
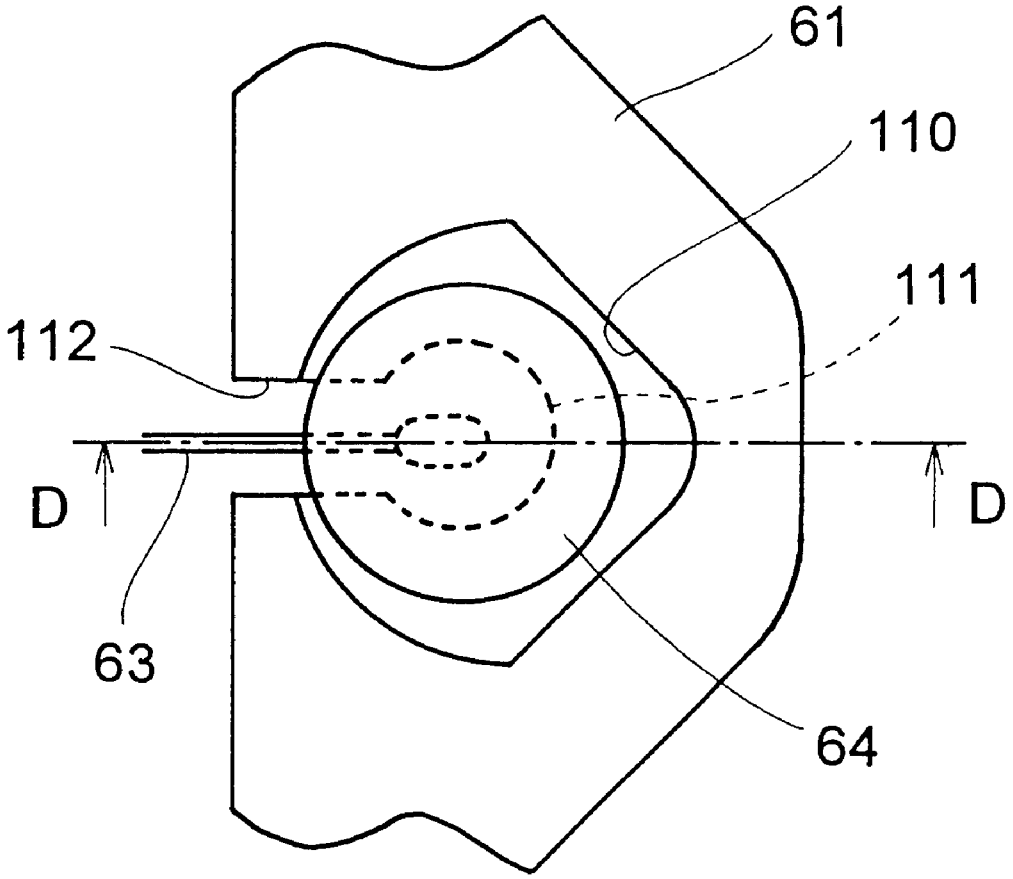
FIG.26 PRIOR ART
FIG. 26 is a partial top view, similar to FIG. 3, showing an example of the suspension mechanism in the prior art.
Figure 27:
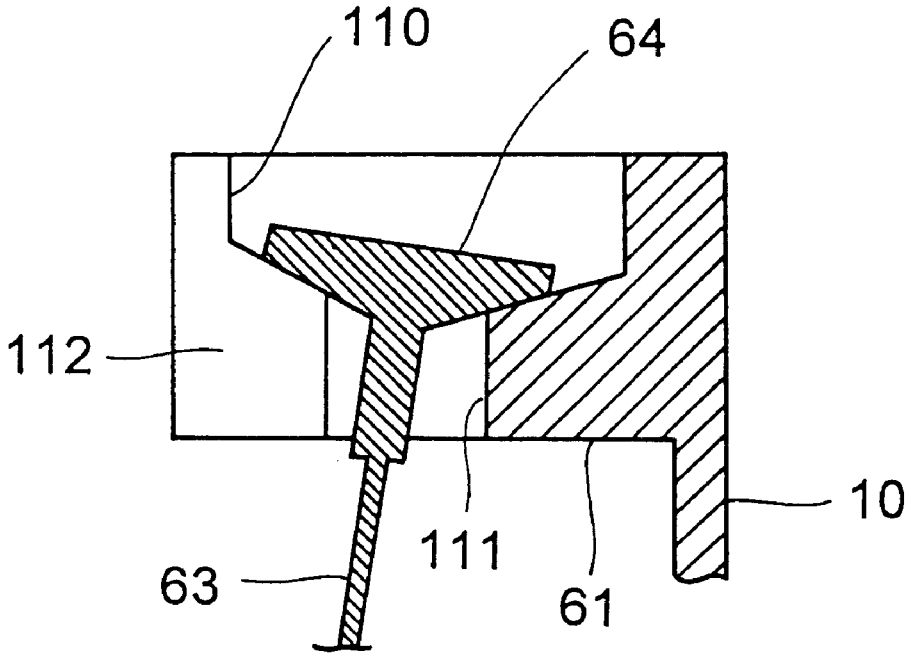
FIG.27 PRIOR ART
FIG. 27 is a sectional view taken on line D—D in FIG. 26.

The prior-art technique of connecting the rods 63 to the upper receptors 61 will be described with reference to FIGS. 26 and 27. On the top of the upper receptor 61 is formed a recess 110 to accept the upper support 64, and at the bottom of the recess 110, a hole 111 is formed with such a diameter that allows the rod 63 to pass through but does not allow the upper support 64 to. The upper receptor 61 has a slit 112 which has an inlet at the side of the upper receptor 61 facing the washing-tub assembly 20. The slit 112 joins the hole 111 and serves as a path for the rod 63 to be placed in the hole 111. The width of this slit 112 is so set as to allow the rod 63 to pass through but does not allow the upper support 64 to. The upper support 64 fits in the recess 110, and with the upper support 64 as point of support, the rod 63 swings in vertical planes. To remove the rod 63 from the upper receptor 61, the washing-tub assembly 20 has to be lifted to lighten the load on the upper support 64, and then the rod 63 is pulled up and removed from the recess 110. If one person does this work, he/she has to support the washing-tub assembly 20 by one hand and lift the rod 63 with the other hand. But the washing-tub assembly 20, which includes the motor 40 and the drain valve 50, is rather heavy. In practice, this is a job for two personnel. If the work is to be done by one person, he/she needs mechanical assistance.

Figure 3:
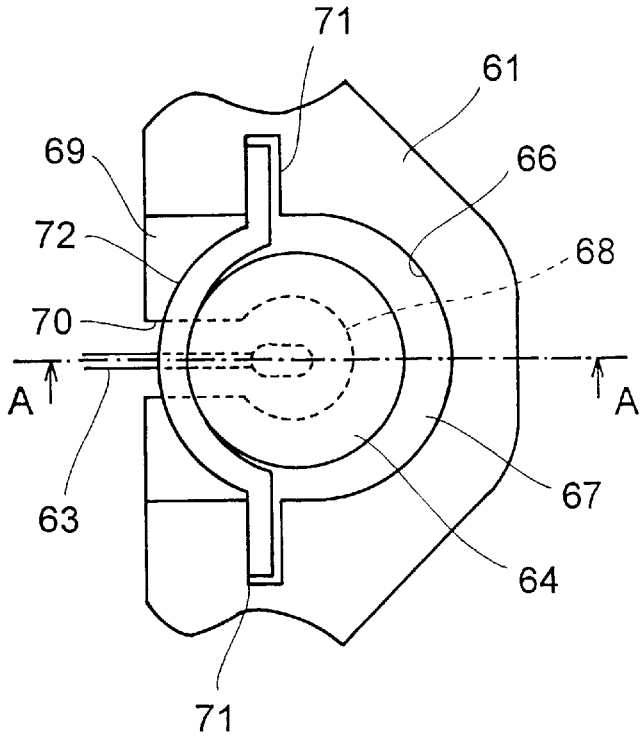
FIG. 3 is a partial top view of the first embodiment of the suspension mechanism of the washing-tub assembly according to the present invention.
Figure 4:
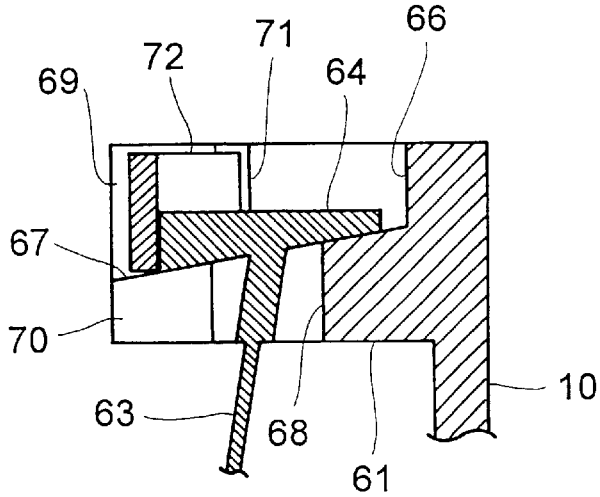
FIG. 4 is a sectional view taken on line A—A in FIG. 3.

To solve the problems with the prior-art construction, the following arrangements are incorporated. On the top of the upper receptor 61, a recess 66 is formed to receive the upper support 64 of the rod 63 as shown in FIGS. 3 and 4. The bottom 67 of the recess 66 is provided with a hole 68 with such a diameter that allows the rod 63 to pass through but does not allows the upper support 64 to. The recess 66 opens toward the washing-tub assembly 20. Toward this opening 69, the bottom 67 slants downward. A slit 70 that passes through the bottom 67 is formed, extending from the opening 69 to the hole 68. The width of the slit 70, too, is such that the rod 63 is allowed to pass through while the upper support 64 is not. The inside wall of the recess 66 is provided with a pair of grooves, 71 opposite to each other, and both ends of an Ω-shaped retainer 72 are put into the grooves 71. The retainer 72 is so designed to be strong enough to stand the pressure from the upper support 64. As long as this purpose is achieved, the retainer 72 can be in any form. But it is preferable that the material is selected in consideration of recycling or re-use.

The rod 63 is supported with the upper support 64 placed on the bottom 67 of the recess 66. The rod 63 extends through the hole 68 and is suspended from the upper receptor 61. In this sate, the rod 63 can swing within the vertical planes with the upper support 64 as point of support. Because the lower support 65 supports the water tub 21 at a position offset toward the tub center from the upper receptor 61, and also because the bottom 67 slants downward to the opening 69, force always acts on the rod 63 in such a way as to push it out of the upper receptor 61 through the slit 70, but the retainer 72 comes in contact with the upper support 64 to stop it.

If the retainer 72 holding the rod 63 in the hole 68 as shown in FIGS. 3 and 4—the first position of the retainer—is pulled out of the grooves 71—the second position of the retainer—, the upper support 64 slides along the bottom 67 of the recess 66 and the rod 63 comes out of the upper receptor 61 through the slit 70. In other words, the washing-tub assembly 20 can be separated from the housing 10 by merely removing the retainers 72 from the four upper receptors 61 without raising the washing-tub assembly 20. The work can be done by one person without mechanical assistance.

The time required for breaking up the suspension mechanism of this embodiment and that of the prior-art washing machine was worked out using DFE (Design for environment), a software for evaluation of the breaking up time developed by BDI (Boothroyd Dewhurst Inc.), an American corporation. For breaking up the prior-art suspension mechanism, the following times were required: 4.2 seconds to get necessary tools ready and 22.5 seconds to remove a rod for a total of 94.2 seconds. For the present embodiment, the following times were needed: 4.4 seconds to remove one retainer and 3.8 seconds to remove one rod for a total of 32.8 seconds.

Figure 5:
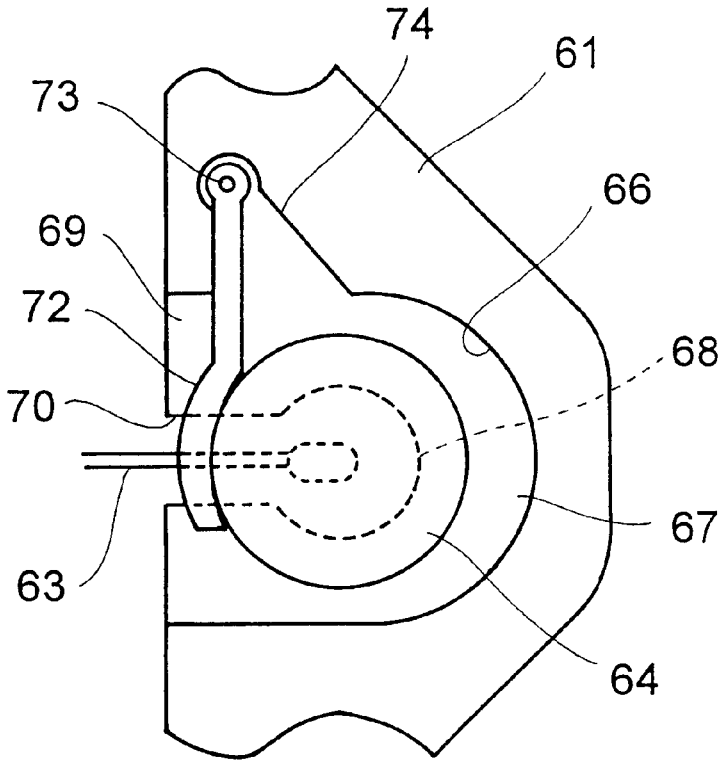
FIG. 5 is a partial top view of the second embodiment of the suspension mechanism of the washing-tub assembly according to the present invention.

FIG. 5 shows a second embodiment of the retainer 72. In FIG. 5, the same reference numbers are used to refer to the similar component parts as in the first embodiment. The retainer 72 in the second embodiment has one end held by the pivot 73 and can swing on the bottom 67 of the recess 66. The pivot 73 is provided at the pivotal point of a sector-shaped recess 74 so formed at one side of the recess 66 that the movement of the retainer 72 is limited within the angle of the sector. The retainer 72 can be raised in the axial direction of the pivot 73. FIG. 5 shows the retainer 72 resting on the inner wall of the recess 74 to keep the rod 63 from getting out of the hole 68—the first position of the retainer.

Figure 6:
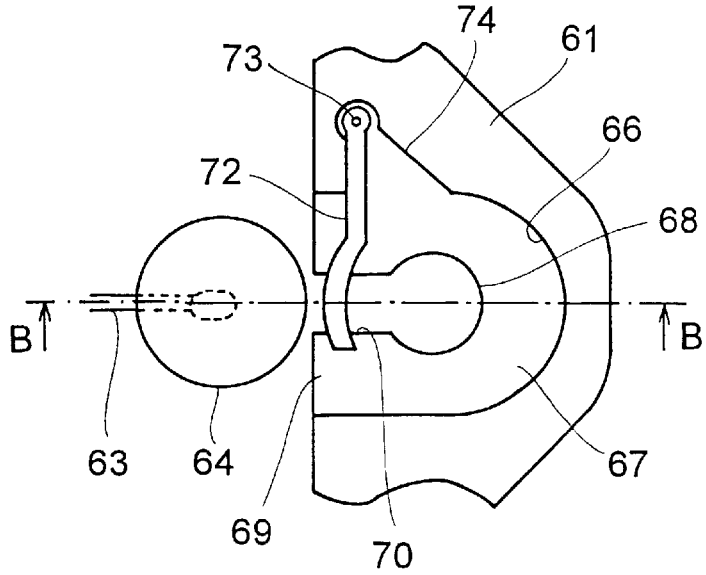
FIG. 6 is a partial top view, similar to FIG. 5, showing the first step of assembling.
Figure 7:
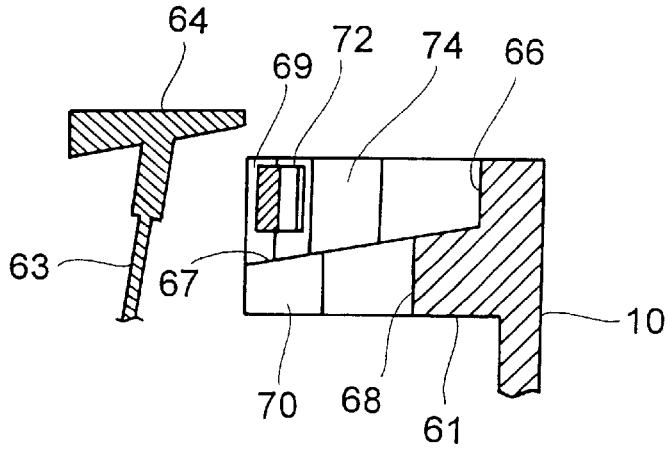
FIG. 7 is a sectional view taken on line B—B in FIG. 6.
Figure 8:
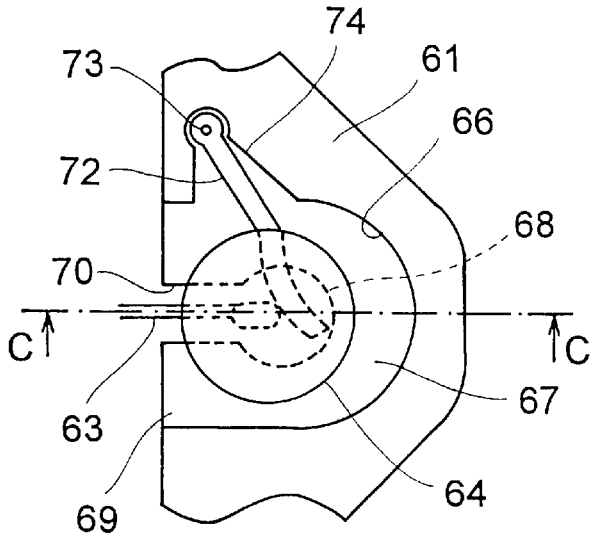
FIG. 8 is a partial top view, similar to FIG. 5, showing the second step of assembling.
Figure 9:
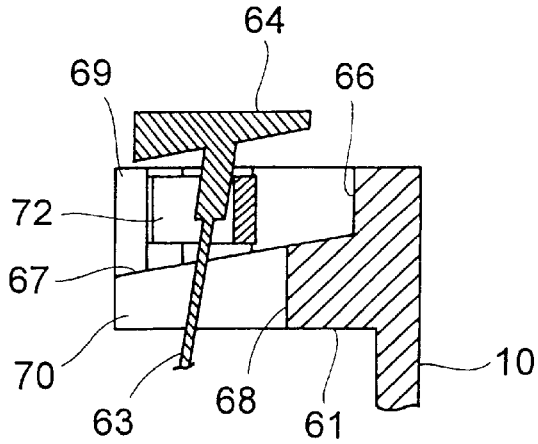
FIG. 9 is a sectional view taken on line C—C in FIG. 8.

To put the rod 63 into the hole 68, the rod 63 is first placed outside the slit 70 as shown in FIGS. 6 and 7. Then, the rod 63 is pushed against the retainer 72 as shown in FIGS. 8 and 9. Pushed by the rod 63, the retainer 72 retreats with the pivot 73 as center of rotation and allows the rod 63 to pass. After the rod 63 has passed, the retainer 72 turns back to the position to prevent the rod from coming out—the first position of the retainer. The retainer 72 can be turned back to the first position by finger or a return spring. It may also be so arranged that the lower part of the upper support 64 may formed in such a way that its diameter gradually reduced downward by tapering or forming a spherical shape so that after the rod 63 reaches the hole 68 and as the rod 63 is lowered, the slope on the upper support 64 pushes the retainer 72 back into the first position.

In the position shown in FIG. 5, if the retainer 72 is raised in the axial direction of the pivot 73 and removed from the recess 66—the second position of the retainer 72—, the upper support 64 loses the support and slides out along the bottom 67 of the recess 66 and the rod 63 comes out of the upper receptor 61 through the slit 70. That is, the washing-tub assembly 20 can be separated from the housing 10 by merely pulling up the retainers 72 at the four upper receptors 61.

It is noted that what is common to the first and second embodiments is that the retainer 72 is concave at where the upper support 64 rests and that when the retainer 72 is in the first position, the rod 63 is positioned at or near the center of the hole 68. That is a measure taken to avoid the rod 63 hitting the inside wall of the hole 68 to make noise or to wear itself when the rod 63 swings. It is also noted that the diameter of the hole 68 is larger than the width of the slit 70, but this is not an essential requirement. Even if the width of the slit 70 is the same as the diameter of the hole 68 and if the shape of the slit 70 is incorporated with that of the hole 68, that constitutes by no means a departure from the spirit of the present invention.

Figure 28:
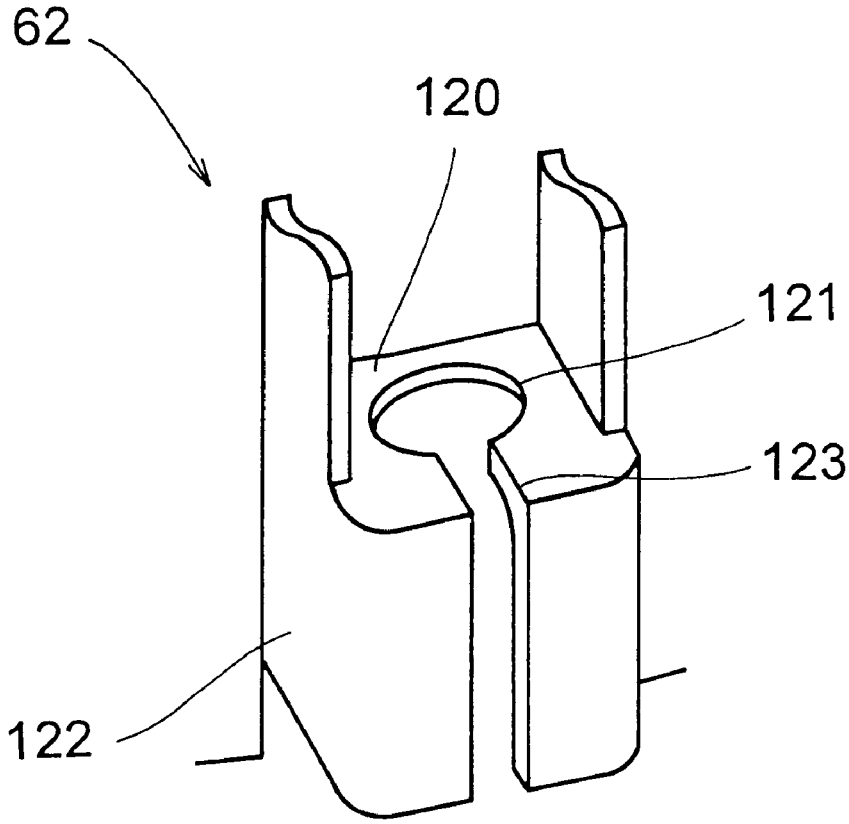
FIG.28 PRIOR ART
FIG. 28 is a partial top view, similar to FIG. 10, showing an example of the suspension mechanism in the prior art.

The arrangement for separating the rod 63 from the lower receptor 62 will be described. FIG. 28 shows the prior-art construction of the lower receptor 62. The lower receptor 62 is cylindrical with a closed top and an open bottom. The top portion 120 is provided with a hole 121 with such a diameter that allows the rod 63 to pass but does not allow the lower support 65 to. A slit 123 extends from the hole 121 to the side wall 122 of the lower receptor 62. The slit 123, too, has such a width as to allow the rod 63 to pass but not to allow the lower support 65 to. In this lower receptor 62, the lower support 65 is received, and the rod 63 extends upward through the hole 121. In the prior-art construction, the angle of the joining or meeting point between the hole 121 and the slit 123 is sharp. In the breaking-up work, therefore, when the rod 63 is to be removed from the lower receptor 62, the washing-tub assembly 20 has to be lifted to remove the lower support 65 from the lower receptor 62, and then the rod 63 has to be moved and passed through the slit 123. If the work should be done by one person, he/she has to hold the washing-tub assembly 20 by one hand and to move the rod 63 with the other hand. But the washing-tub assembly 20, which includes the motor 40 and the drain valve 50, is rather heavy. In practice, this is a job for two personnel. If the work is to be done by one person, he/she needs mechanical assistance.

Figure 10:
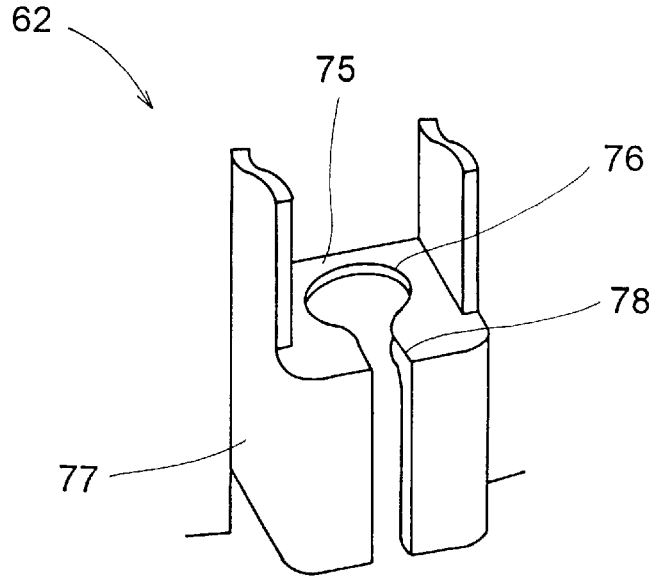
FIG. 10 is a partial perspective view showing the first embodiment of another part of the suspension mechanism of the washing-tub assembly according to the present invention.

To solve the problems with the prior-art construction, the following arrangements are incorporated in the present invention. As shown in FIG. 10, the top portion 75 of the lower receptor 62 is provided with a hole 76 with such a diameter that allows the rod 63 to pass through but does not allow the lower support 65 to. A slit 78 extends from the hole 76 to the side wall 77 of the lower receptor 62 with such a width that allows the rod 63 to pass but does not allow the lower support 65 to. The angle of the joining or meeting point between the hole 76 and the slit 78 is rounded in the shape of an arc. For example, the following specifications may be adopted: 4 mm for the diameter of the rod 63, 40 mm for the diameter of the lower support 65, 20 mm for the diameter of the hole 76, 6 mm for the width of the slit 78, 7 mm for the radius of the arc in the rounded part. These figures only constitute an example, and the present invention has no specific limitation concerning the dimensions of the embodiments.

Figure 11:
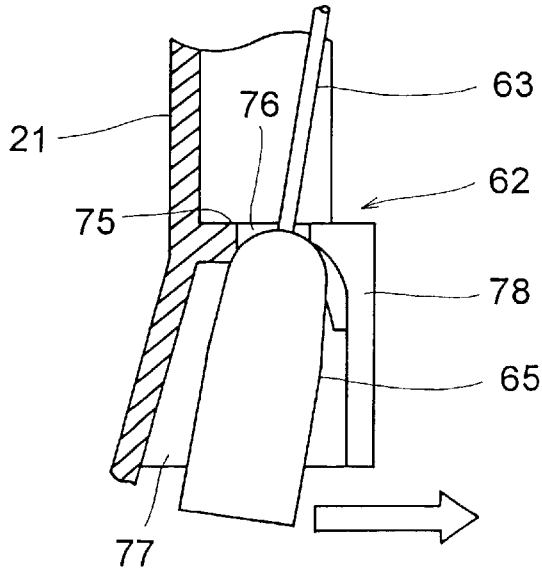
FIG. 11 is a vertical, sectional view of the part in FIG. 10.

The rod 63 supports the water tub 21 with the lower support 65 engaging with the lower receptor 62 as shown in FIG. 11. If the water tub 21 is raised in this state, the lower support 65 moves relatively downward within the lower receptor 62. When the lower support 65 comes out of the lower receptor 62, the rod 63 swings outward in the direction radial to the center of the washing-tub assembly 20 with the upper receptor 61 as point of support, and slides along the inside wall of the hole 76. Then, guided by the rounded part of the joining point of the hole 76 and the slit 78, the rod 63 automatically slides into the slit 78 and comes out of the lower receptor 62 through the slit 78. By merely lifting the washing-tub assembly 20, the rod 63 moves by itself and gets out of the lower receptor 62. The work can be done by one person without mechanical assistance.

The time required for breaking up the suspension mechanism of this embodiment and that of the prior-art washing machine was worked out using said DFE software. For breaking up the prior-art suspension mechanism, the following times were required: 4.2 seconds to get necessary tools ready and 22.5 seconds to remove a rod for a total of 94.2 seconds. For the present embodiment, the time needed for raising the washing-tub assembly is not defined in DFE, so, the actual time was measured. The following times were needed: 10 seconds to raise the washing-tub assembly, and 3.8 seconds to remove one rod for a total of 25.2 seconds.

Figure 12:
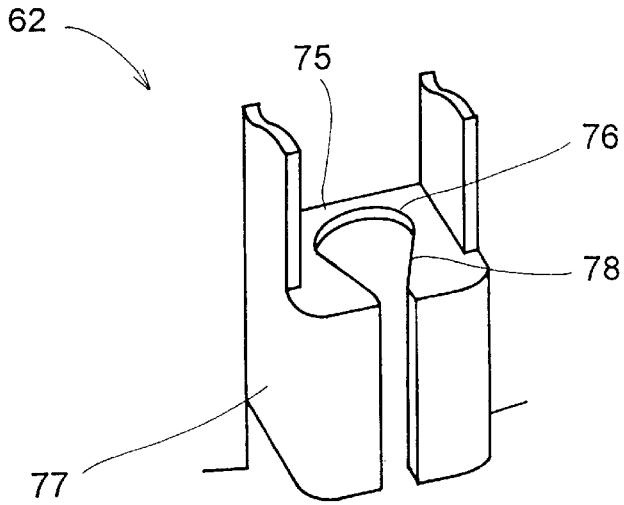
FIG. 12 is a partial perspective view, similar to FIG. 10, showing the second embodiment of that part.
Figure 13:
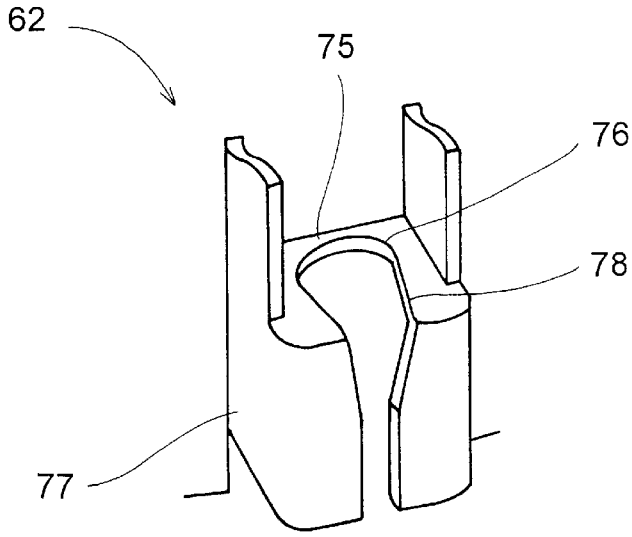
FIG. 13 is a partial perspective view, similar to FIG. 10, showing the third embodiment of that part.

FIGS. 12 and 13 show arrangements to further facilitate removal of the rod 63 from the hole 76. In FIGS. 12 and 13, the same reference numerals are used to refer to the similar component parts as in the first embodiment. In the second embodiment shown in FIG. 12, the width of the slit 78 is widened in the form of a taper from the junction of the top portion 75 and the side wall 77 of the lower receptor 62 to the maximum width point of the hole 76. Seen from the hole 76, a taper-shaped guideway is formed down to the point of the original width of the slit 78. That makes the move of the rod 63 smoother. In the third embodiment shown in FIG. 13, the shape of the slit is further modified. That is, from the middle point at the side wall 77 of the lower receptor 62 up to the junction of the top portion 75 and the side wall 77, the slit 78 gradually widens its width, and from said junction the slit 78 is further widened up to the maximum width point of the hole 76. That furthermore makes it easier to remove the rod 63 than in the second embodiment.

Figure 29:
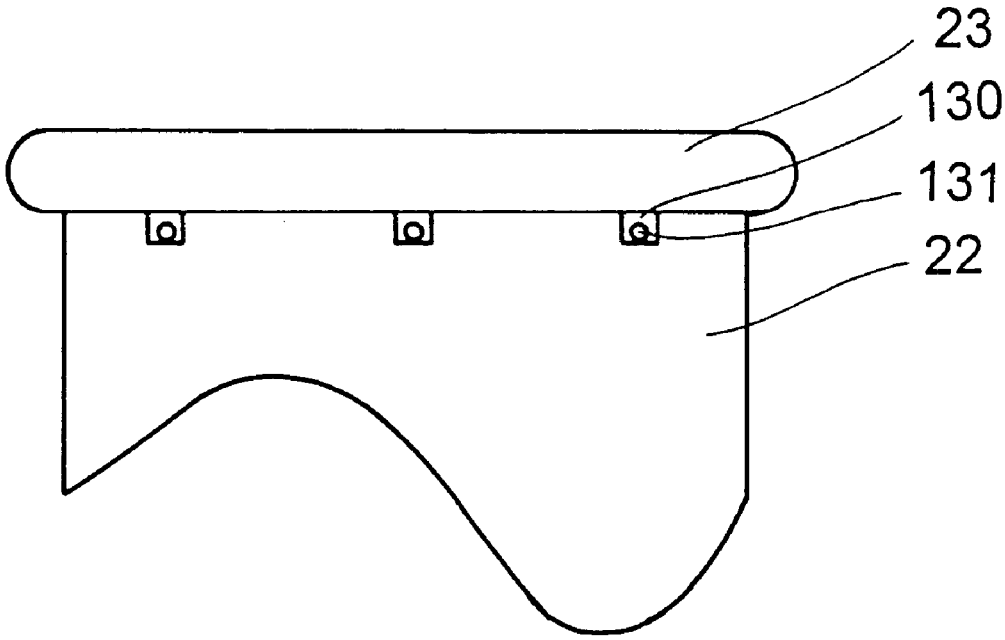
FIG.29 PRIOR ART
FIG. 29 is a partially sectional view of the spin tub showing an example of the prior art technique of mounting the balancer.

The mounting of the balancer 23 on the spin tub 22 will now be described in the following. FIG. 29 shows the prior-art mounting arrangement of the balancer 23. The balancer 23 has a number of protrusions 130 extending downward. Those protrusions 130 are fixed to the spin tub 22 by screws. It takes substantial amount of time to remove all those screws even if a power driver is used, and hence, becomes a block to the speedy breaking up of the washing machine.

Figure 14:
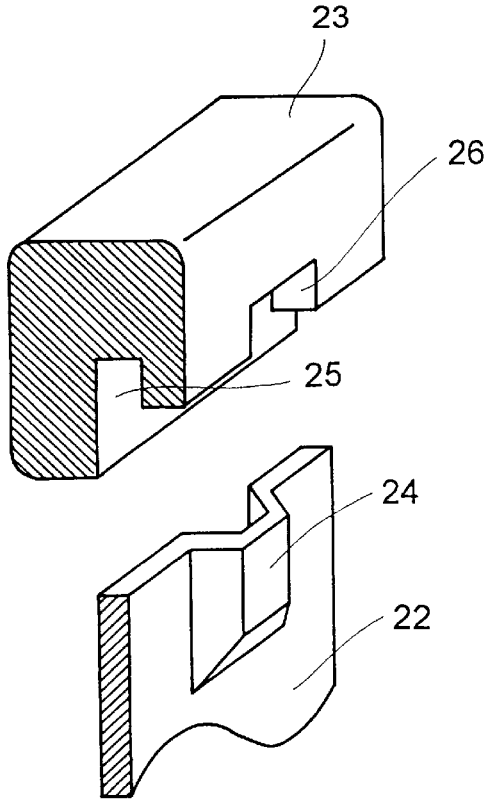
FIG. 14 is a partial perspective. view showing the first embodiment of the joining point of the spin tub and the balancer. according to the present invention.

To solve the problems with the prior-art construction, the following arrangements are incorporated. FIG. 14 shows one of the fixing points of the balancer 23. The upper edge of the spin tub 22 is provided with one or more protrusions 24 that extend outward. The underside of the balancer 23 is provided with an annular groove 25 to receive the upper edge of the spin tub 22 and recesses 26 to receive the protrusions 24. When the upper edge of the spin tub 22 is inserted into the groove 25 with the protrusions 24 fit into the recesses 26, the balancer 23 is held not to rotate relative to the spin tub 22. The same results can be obtained by forming protrusions 24 extending inward the spin tub 22 and providing recesses 26 at the corresponding positions. Then, to hold the balancer 23 in place against rifting force, the balancer 23 and the spin tub 22 are fastened to each other by screws 27 shown in FIG. 1. The number of screws required that is rather small. If the screws 27 are loosened and the balancer 23 is pulled upward, the balancer 23 can be separated from the spin tub 22.

Figure 15:
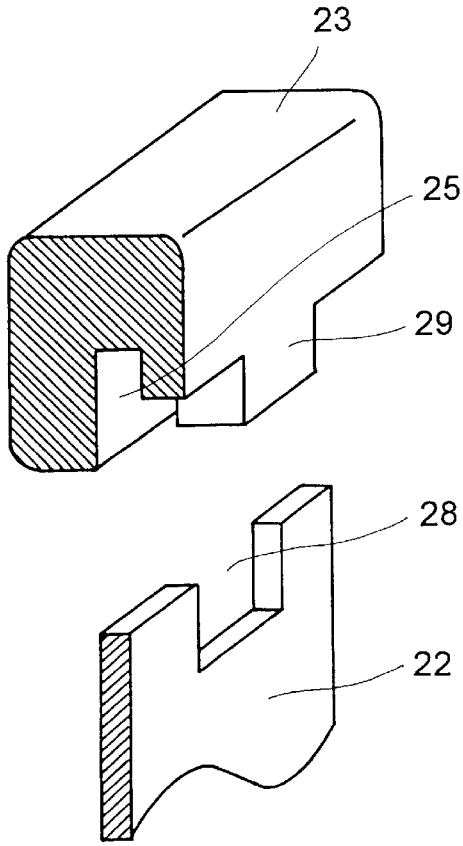
FIG. 15 is a partial perspective view showing the second embodiment of the joining point of the spin tub and the balancer according to the present invention.
Figure 16:
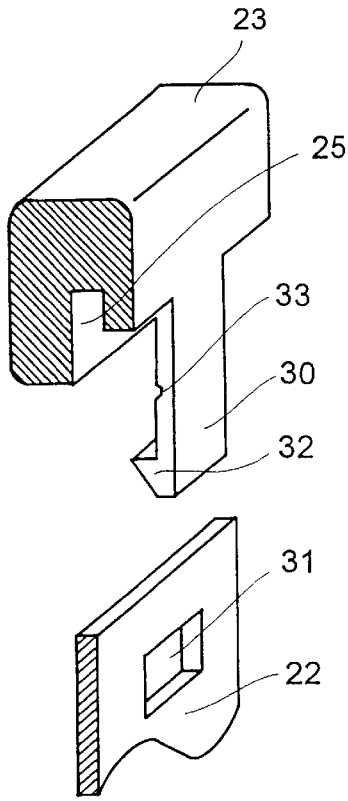
FIG. 16 is a partial perspective view showing the third embodiment of the joining point of the spin tub and the balancer according to the present invention.
Figure 17:
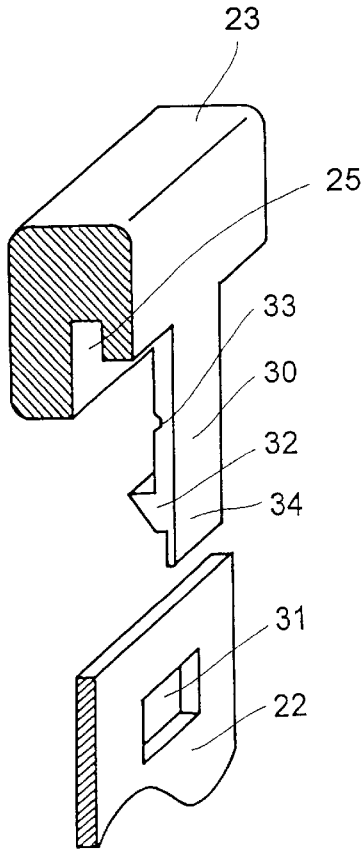
FIG. 17 is a partial perspective view showing the fourth embodiment of the joining point of the spin tub and the balancer according to the present invention.

FIGS. 15 to 17 show other embodiments of fixing the balancer 23. In those drawings, the same reference numerals are used to refer to the similar component parts as in the first embodiment. In the second embodiment shown in FIG. 15, the upper edge of the spin tub 22 is provided with one or more notch-like recesses 28. The underside of the balancer 23 is provided with a groove 25 to receive the upper edge of the spin tub 22 and protrusions 29 to engage with the recesses 28. When the upper edge of the spin tub 22 is inserted into the groove 25 with the protrusions 29 fit into the recesses 28, the balancer 23 will not rotate relative to the spin tub 22. In this example, too, the screws 27 are put in place to keep the balancer 23 from coming off. If the screws 27 are unscrewed and the balancer 23 is pulled upward, the balancer 23 can be separated from the spin tub 22.

In the third embodiment shown in FIG. 16, one or more connecting fingers 30 are provided at the underside of the balancer 23 along with the circular groove 25 to receive the upper edge of the spin tub 22. The connecting fingers 30 are located on the outside wall of the balancer 23, extending downwards therefrom. The connecting fingers 30 have claws 32 at their tips that engage with recesses 31 provided in the upper portion of the spin tub 22. And a horizontal notch 33 is provided in the stem portion of each connecting finger 30. Being pressed against the spin tub 22 with the connecting fingers 30 and recesses 31 in alignment with each other and the upper edge of the spin tub 22 being inserted into the groove 25, the balancer 23 is fixed to the spin tub 22 without using screws, with the claws 32 of connecting fingers 30 engaging with the recesses 31 of the spin tub 22. When the balancer 23 should be removed from the spin tub 22, the connecting fingers 30 are pulled outward to make the claws 32 come out of the recesses 31, thereby enabling the balancer 23 to be lifted. The connecting fingers 30 bend at the notches 33. If the connecting fingers 30 have been permanently deformed, there is no need for them to be kept pulled not the claws 32 to engage the recesses 31, thus the labor for separating the balancer 23 is significantly relieved.

The positional relation between the recess 31 and the claws 32 can be reversed. That is, the connecting finger 30 is provided with the recess 31 and the spin tub 22 is provided with the claw 32. It is also noted that, in the embodiment shown in FIG. 16 the notch 33 is provided on the side wall of the connecting finger 30 facing the spin tub 22, though, the notch 33 can be provided on the opposite side or on both sides of the connecting finger 30. In consideration of easy bending, it is preferable to provide the notch 33 on the side facing the spin tub 22. The shape and depth of the notch 33 should be decided taking the design factors of the connecting finger 30 such as width, thickness and length and material thereof into consideration. The number of notch 33 for each connecting finger 30 may be doubled or tripled.

To securely fix the balancer 23 on the spin tub 22, a plurality of connecting fingers 30 are provided on the circumference of the balancer 23, preferably at equal intervals. The form of the claw 32 and the recess 31 should be such that the balancer 23 is securely held in place.

The fourth embodiment shown in FIG. 17 is a modification of the third embodiment. In the fourth embodiment, a protrusion 34 is added to the tip of the connecting finger 30. The protrusion 34 can be caught with a finger or a tool, which furthermore facilitates the bending outward of the connecting finger 30. It is noted that in FIG. 17 the protrusion 34 extends downward from the lowermost end of the connecting finger 30, but this is by no means compulsory. The protrusion 34 may be at anywhere near the tip of the connecting finger 30 and there is no limitation on its direction and form. They should be decided taking the kind of the tool to be used into consideration.

The time required for removing the balancers of the first and third embodiments shown respectively in FIGS. 14 and 16 and that of the prior-art washing machine was worked out using said DFE software. In the prior-art construction, the balancer is fixed on the spin tub with six screws. For breaking up the prior-art construction, the following times were required: 4.2 seconds to get necessary tools ready and 26.4 seconds to unscrew the screws, and 3.8 seconds to remove the balancer for a total of 30.2 seconds. For the embodiment in which three screws are used, 4.2 seconds to get necessary tools ready, 11.1 seconds to unscrew the screws, and 3.8 to remove the balancer for a total of 19.1 seconds. For the embodiment without screws shown in FIG. 16, 4.2 seconds to get necessary tools ready, 5.4 seconds to bend the connecting fingers, and 3.8 seconds to remove the balancer for a total of 13.4. As shown, it took 26.4 seconds to unscrew six screws on the prior-art construction balancer, the time required for removal of screws in the first embodiment is only 11.1 seconds and the time required for bending the three connecting fingers in place of unscrewing in the first embodiment was only 5.4 seconds. In either of the cases, the time for the breaking up the balancer was shortened. It should be noted that in any one of above washing machines, the fixing of balancer had been sound enough.

Figure 30:
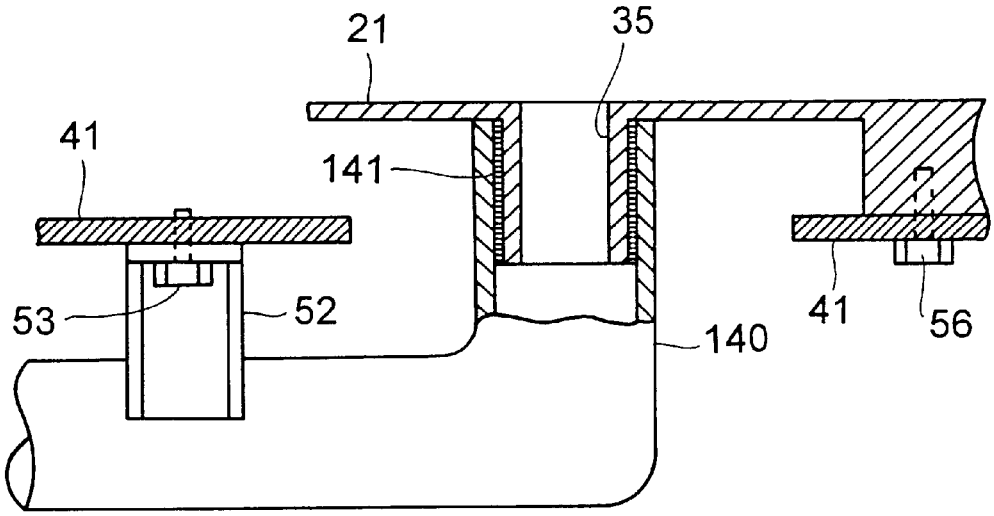
FIG.30 PRIOR ART
FIG. 30 is a sectional view, similar to FIG. 18, showing an example of the construction of the drain valve connection in the prior art.

The fixing of the drain valve 50 will be described. FIG. 30 shows the prior-art construction of the fixing of the drain valve 50. The inlet pipe 140 of the drain valve 50, which is elbow-formed, is fixed via a stay 52 by a screw to the mounting plate 41 of the motor 40, which in turn fixed to the water tub 21 by screws., The end of the inlet pipe 140 fit over the drain mouth 35 protruding from the bottom of the water tub 21. To prevent leakage of water, the drain mouth 35 and the inlet pipe 140 are bonded with adhesive 141. To break up a washing machine of this construction, the inlet pipe 140 has to be forcibly pulled off from the joint cemented with adhesive 141. If it cannot be pulled off, the inlet pipe 140 or drain mouth 35 has to be cut off. The adhesive remaining on the water tub 21 and the inlet pipe 140 after the breaking-up work deteriorates the quality of the synthetic resin recycled from the water tub 21 or the inlet pipe 140.

Figure 18:
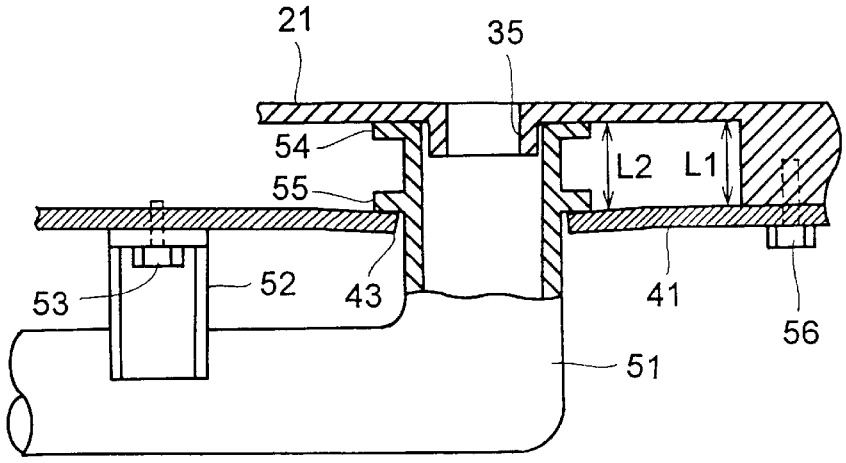
FIG. 18 is a sectional view showing the first embodiment of the construction of the drain valve connection to the water tub according to the present invention.
Figure 22:
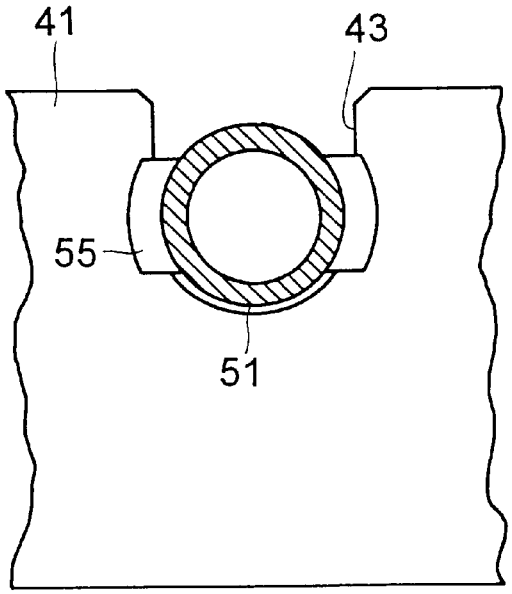
FIG. 22 is a partial top view, similar to FIG. 21, showing the second embodiment of that part.

To solve the problems with the prior art construction, the following arrangements are incorporated. In FIG. 18, the inlet pipe 51 of the drain valve 50 is molded in the form of an elbow, with the middle part fixed to the mounting plate 41 of the motor 40 via the stay 52 by screws. A short cylindrical drain mouth 35 protrudes from the underside of the water tub 21. The flange portion 54 at the end of the inlet pipe 51 is fit over the drain mouth 35. The flange portion 54 has to be firmly placed on the underside of the water tub 21 so that no water may leak out. For this purpose, protrusions 55 are provided on the outside wall of the inlet pipe 51. It is desirable that the protrusions 55 are positioned symmetrically. The mounting plate 41 is provided with an opening 43 into which the inlet pipe 51 is inserted and on which edge the protrusions 55 rest. The following arrangements are made the inlet pipe 51 to pass through the mounting plate 41. The top-view contour of the inlet pipe 51, including the flange portion 54 and the protrusions 55, is formed non-circular, and the opening 43 is formed in the similar shape. The flange portion 54 and the protrusions 55 can pass through the opening 43 at a specific relative angle. After the protrusions 55 have passed thorough the opening 43, the relative angle between the mounting plate 41 and the inlet pipe 51 is changed so that the edge of the opening 43 engages with the protrusions 55. Another way is possible. A slit, to be used as the opening 43, is made by cutting the edge of the mounting plate 41 as shown in FIG. 22. The inlet pipe 51 is inserted from the edge of the mounting plate 41 to the opening 43 engaging the protrusions 55 with the opening 43.

The mounting plate 41 is fixed on a pedestal-like protruding portion extending downward from the underside of the water tub 21 by screws 56. The height L1 of the pedestal-like protruding portion is shorter than the distance L2 between the upper side of the flange portion 54 and the lower side of the protrusions 55. Therefore, when the screws 56 are tightened up, the mounting plate 41 slightly bends due to its elasticity and applies pressure on the inlet pipe 51, and the flange portion 54 is pressed against the underside of the water tub 21.

Figure 19:
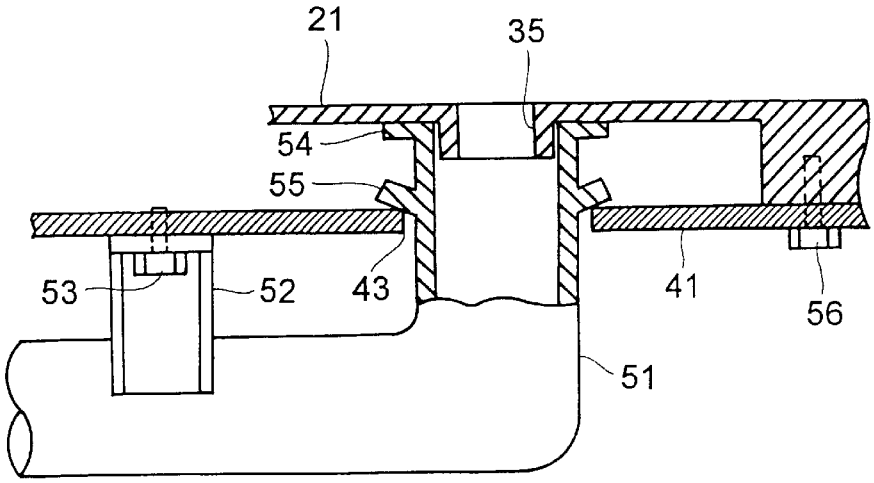
FIG. 19 is a sectional view showing the second embodiment of the construction of the drain valve connection to the water tub according to the present invention.

The inlet pipe 51 may be molded of a highly elastic material so that when it is pressed by the mounting plate 41, spring-back force of the bended protrusions 55 makes the inlet pipe 51 to force its flange portion 54 pressed against the water tub 21. This second embodiment is shown in FIG. 19.

Figure 20:
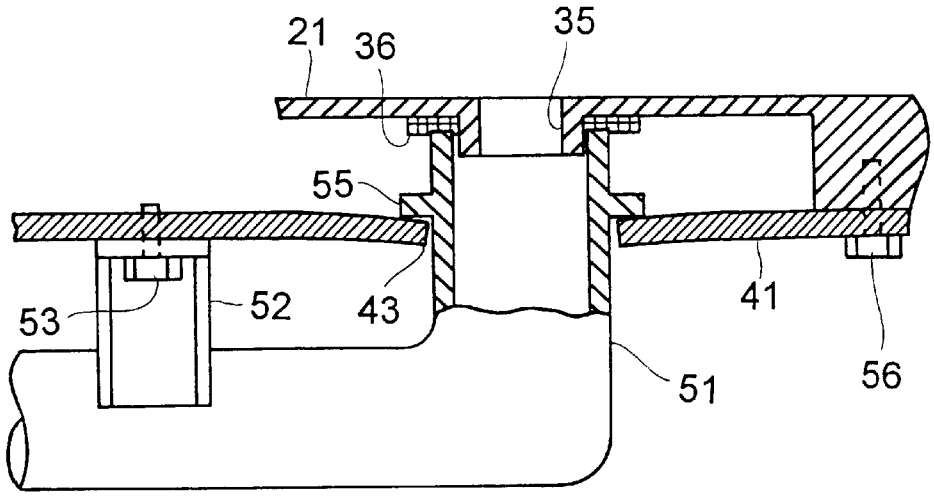
FIG. 20 is a sectional view showing the third embodiment of the construction of the drain valve connection to the water tub according to the present invention.
Figure 21:
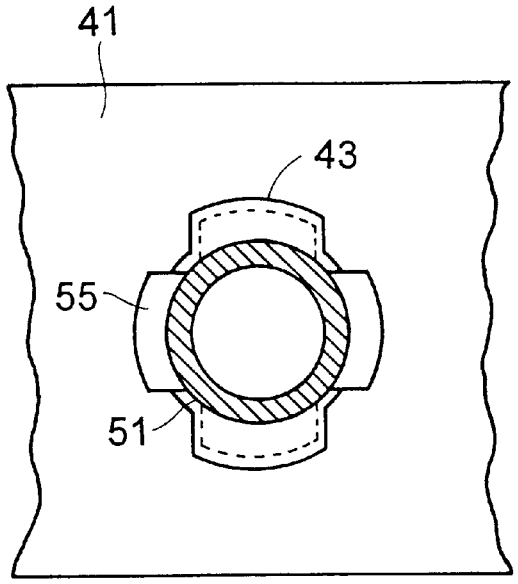
FIG. 21 is a partially sectional top view of the connection of the drain valve to the water tub according to the present invention, showing the first embodiment of that part.

In a third embodiment shown in FIG. 20, a seal 36 is placed around the drain mouth 35 so that the end of the inlet pipe 51 is pressed against this seal 36. No flange portion is formed at the end of the inlet pipe 51. Other details are the same as those in FIG. 18.

As described, the inlet pipe 51 is merely pressed against the water tub 21, and therefore, if the water tub 21 is removed from the mounting plate 41, the drain valve 50 will be separated from the water tub 21, thereby shortening the time needed for the breaking up work. Another feature is, no adhesive is used that the quality of the recycled resin will not be affected by resin residue. Furthermore, the motor 40 and the drain valve 50 can be mounted on the mounting plate 41 before the mounting plate 41 is fixed to the water tub 21, and no adhesive applying step is needed, resulting in time-saving in assembly.

The time required for breaking up such parts as the motor and drain valve of the present embodiment shown in FIG. 18 and the prior-art construction shown in FIG. 30 was worked out using said DFE software. For breaking up the prior-art construction, the following times were required: 40.4 seconds to remove two screws and to separate two press-fitting portions of the drain valve, 33.4 seconds to remove the motor for the drain valve fixed by two screws, 27.4 seconds to cut off and remove the wiring to the motor for the pulsator, and 76 seconds to remove the motor-mounting plate fixed by 10 screws for a total of 177.2 seconds. For the embodiment shown in FIG. 18, on the other hand, 19.5 seconds to cut off and remove the wiring to the motor for the pulsator and 76.4 seconds to remove the motor-mounting plate fixed by ten screws for a total of 95.9 seconds.

The construction and fixing of the top cover will now be described. The front portion (the side nearest to the operator) of the top cover is usually provided with such parts as the operation control unit. On the rear side (the side most remote from the operator) are disposed such parts as a water valve, a bath water pump, a pouring case and a reactor. For fixing those parts on the top cover, there have been disclosed techniques as in Japanese Patent Application Laid-Open H11-9882. This prior art is shown in FIG. 31.

Figure 31:
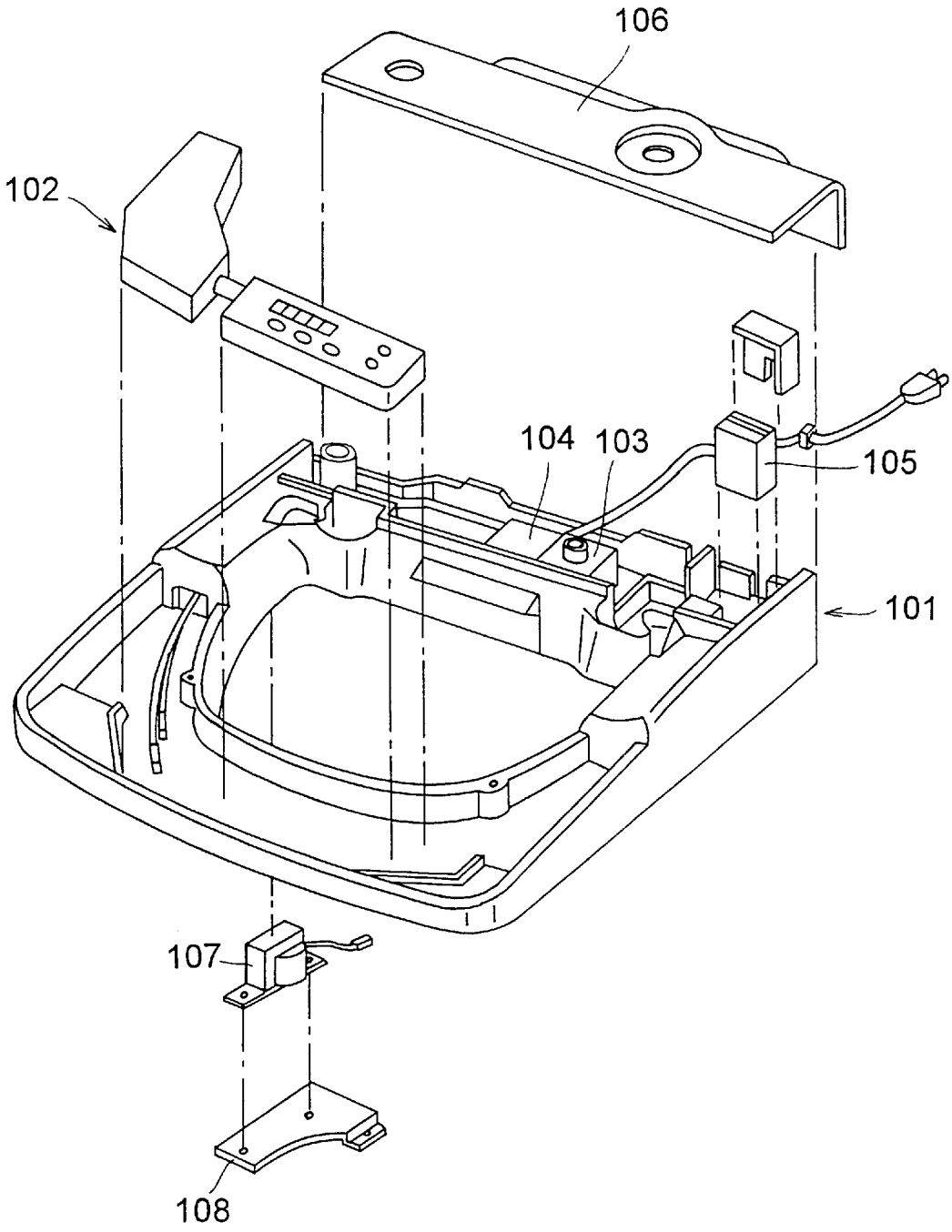
FIG.31 PRIOR ART
FIG. 31 is an exploded perspective view, similar to FIG. 23, showing an example of the prior art top cover construction.

In FIG. 31, the reference numeral 101 indicates a top cover made of synthetic resin which is fixed on the top of the washing machine housing (not shown). The top cover 101 has a sunken portion in the front where an operation control unit 102 is positioned. In the rear portion of the top cover 101 are found such parts as a water valve 103, a water supply unit 104 and a noise filter 105 over which the a rear panel 106 with an L-formed section is placed. The numeral 107 indicates a reactor held in a downwardly opened recess provided in the side portion of the top cover. 101. The numeral 108 indicates a lower panel to close the recess where the reactor 107 is held. This arrangement is adopted to facilitate the fixing of the operation control unit 102, the reactor 107 and the noise filter 105 and wirings among them.

The materials of a washing machine to be recycled are not only such metals as copper and aluminum but also synthetic resins. In a washing machine, considerable amount of synthetic resins are used mainly in the washing-tub assembly and the top cover, so, retrieval of synthetic resins from these portions has much meaning. In the case of the top cover of the prior-art construction as mentioned above, however, many component parts mounted thereon have to be removed prior to the resin-retrieval from the top cover, and this labor takes substantial amount of time and cost. The top cover with the parts might be crushed, and synthetic resin alone might be screened from the shredded dust. But it is not easy to separate synthetic resin from the mixture of metal and synthetic resin fragments. Furthermore, many different kinds of synthetic resins are contained in the mixture, and sorting them out is not an easy task. Even if those synthetic resins are successfully sorted out to some degree, there remains shredded dust anyway. Since the shortage of dump sites for shredded dust will become realistic in the future, a breaking-up scheme that leaves no shredded dust should be pursued.

Figure 23:
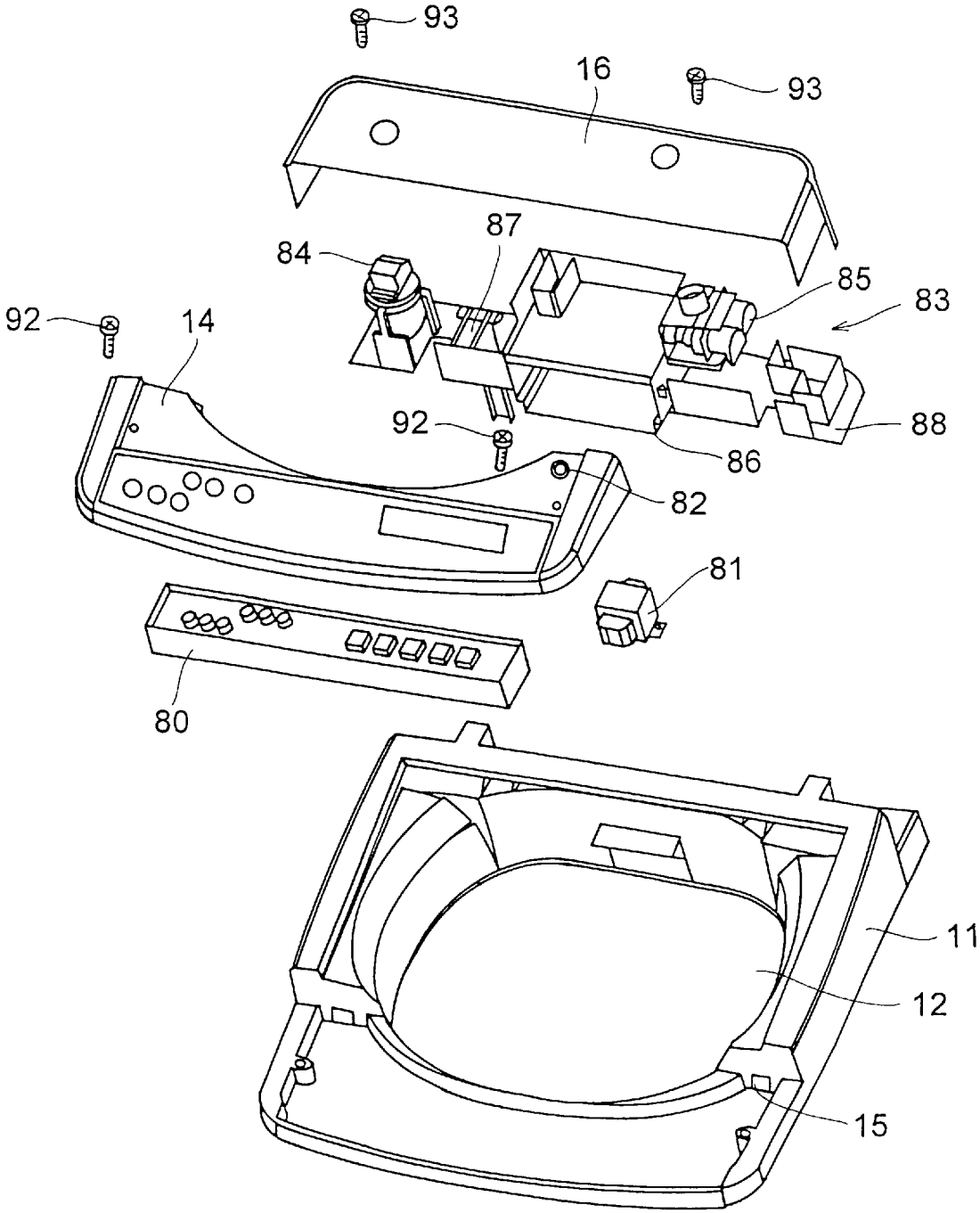
FIG. 23 is an exploded perspective view of the first embodiment of the top cover of the washing machine according to the present invention.

In the present invention, therefore, the following arrangements are made to retrieve synthetic resins from the top cover without prolonging the time needed for breaking up the top cover. The arrangements will be described with reference to FIGS. 23 and 24. The top cover 11 is molded of a synthetic resin like polypropylene and has at its center an opening 12 to throw in or take out washings as shown in FIG. 23. The opening 12 is covered with a lid 13 shown in FIG. 2. The front portion (the side nearest to the operator) and the rear portion (the side most remote from the operator) of the top cover 11 are provided with spaces to accommodate the operation control unit and parts unit. The operation control unit 80 installed in the front portion of the top cover 11 is composed of an operation circuit board having a control switch and a display and an inverter control circuit board to control the operation of the motor, and is fixed on the bottom side of the operation control panel 14 with screws. Also, on the bottom side of the operation control panel 14 is fixed a reactor 81, and on the top side of the operation control panel 14 is found a level 82. Indicated by the numeral 15 in FIG. 23 is a hole provided to be a passage for the wiring to the operation control unit 80.

The reference numeral 83 indicates a parts unit including such parts as a water level sensor 84, a water valve 85, a pouring case 86 and an abnormal vibration sensor 87 and a base 88 on which those parts are mounted. The parts unit 83 is placed in the rear portion of the top cover 11 and covered with a rear panel 16. It is noted that the rear panel 16 and the top cover 11 are molded of the same kind of synthetic resin.

Figure 24:
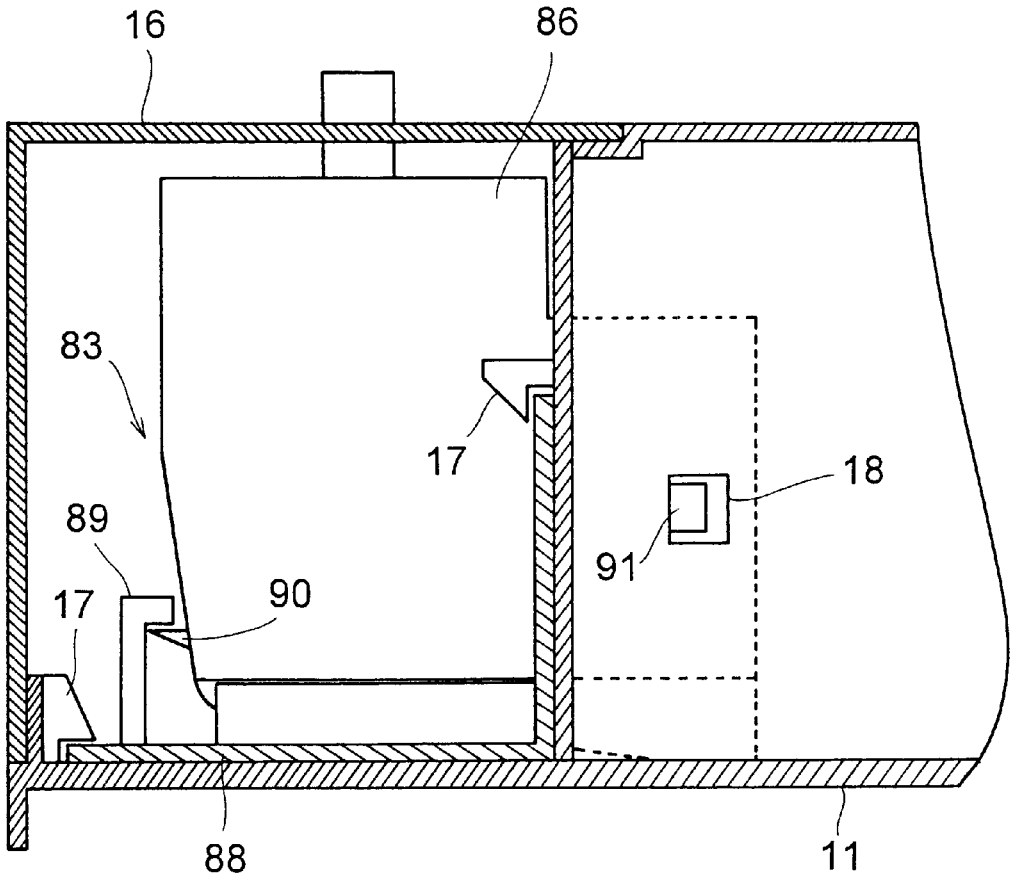
FIG. 24 is a sectional view of the rear portion of the top cover of the washing machine in FIG. 23.

The base 88 is L-formed in section as shown in FIG. 24. On the base 88, devices for the installation of respective parts are formed. For the pouring case 86, for example, a hook 89 is formed on the base 88, and a claw 90 is formed at the end of the pouring case 86. Engaging the hook 89 and the claw 90, the pouring case 86 and the base 88 are united.

The parts unit 83 is fixed on the top cover 11 in the following way. The top cover 11 is provided with four claws 17 at where the parts unit is installed, two claws 17 for one wing of the base 88 having a L-formed section. When the base 88 is pressed against the claws 17, the base 88 and the claws 17 engage elastically with each other, whereby the base 88 and the top cover 11 are connected with each other. Part of the top cover 11 is recessed to accommodate the pouring case 86. A window formed on the side wall of the recess is engaged with the claw 91 of the pouring case 86. As shown, the top cover 11 and the parts unit 83 are united with engaging claws 17, 91.

Then, the top cover 11 is fastened to the housing 10 by four screws. In the front portion, two screws 92 that extend through the operation control panel 14 and the top cover 11 are screwed into the housing 10. Thus, the operation control panel 14 and the top cover 11 are fixed to the housing, 10 in a lump by screws 92. In the rear portion, two screws 93 that pass through the rear panel 16, parts unit 83 (especially, the base 88) and the top cover 11 are screwed into the housing 10. Thus, the rear panel 16, the parts unit 83 and the top cover 11 are all fixed on the housing 10 by common, screws 93.

Figure 25:
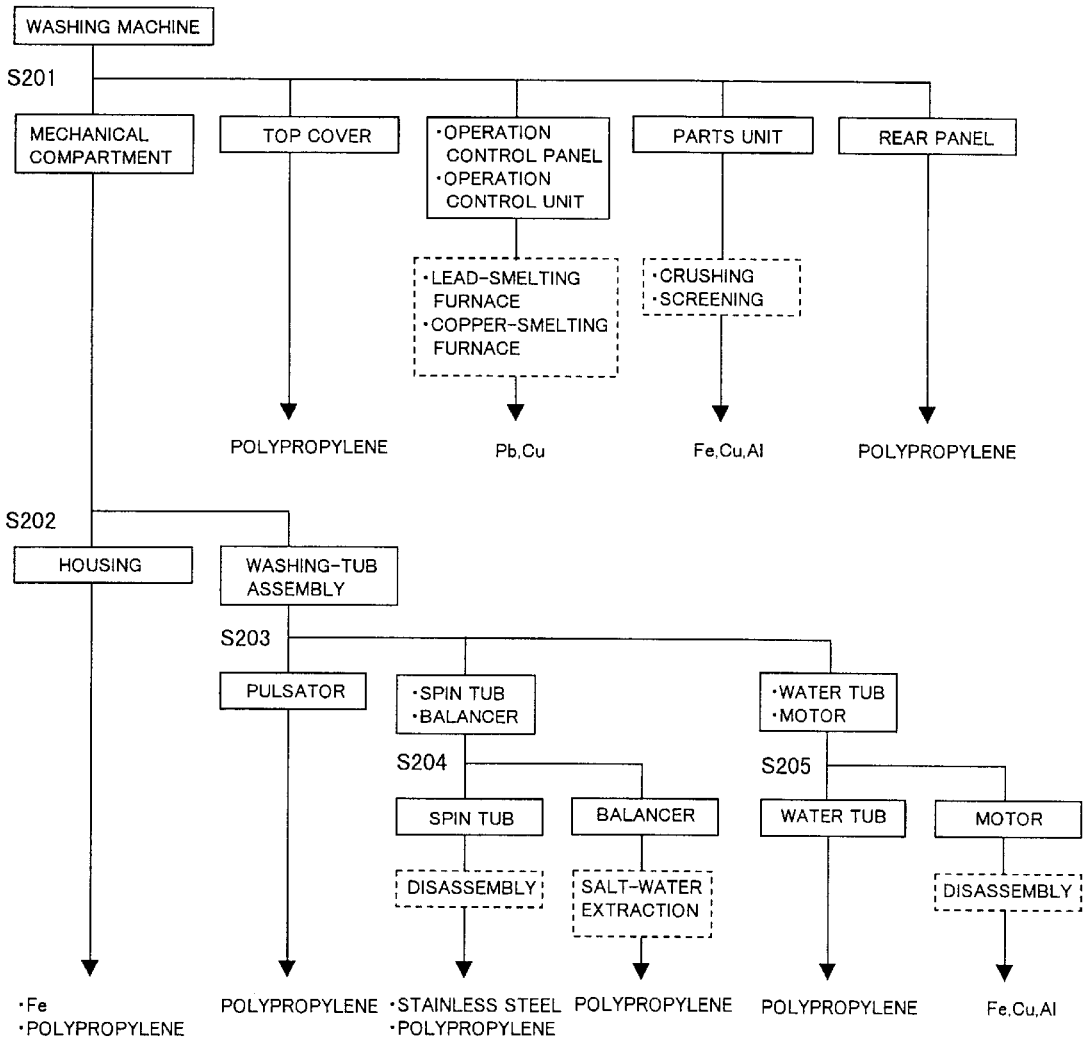
FIG. 25 is a flow chart of breaking-up work showing a first embodiment of the method of breaking up of the washing machine according to the present invention.

The procedure of breaking up the washing machine 1 of the construction of the present invention will be described hereafter with reference to FIG. 25. Step S 201 in FIG. 25 is the step for removing two screws 92 that fix the operation control panel 14 and the top cover 11 on the housing 10 and two screws 93 that fix the rear panel 16, parts unit 83 and top cover 11. Then, the operation control panel 14 is raised to facilitate the cutting-off work of the wiring (not shown) connecting the operation control unit 80 fixed on the bottom side of the panel and the motor 40, parts unit 83, power source etc. After the cutting-off work, the operation control panel 14, the operation control unit 80 and the reactor 81 are removed from the top cover 11 in a lump.

Then, the rear panel 16 is removed, and a pipe (not shown) connecting the water level sensor 84 and water tub 21 is cut off. After that, engagement of the claws 17, 91 is released and the parts unit 83 is removed from the top cover 11. At the same time, the wiring connected to the parts unit 83 is also removed from the top cover 11. Then, the top cover 11 is removed from the housing 10. As a result, the washing machine 1 is broke down into the following portions—mechanical compartment 2, top cover 11, combination of operation control panel 14 and housing 10, parts unit 83, and rear panel 16.

Then in Step S 202, the washing-tub assembly 20 is removed from the mechanical compartment 2, separating from the housing 10.

In Step S 203, the pulsator 38 is removed from the bottom of the spin tub 22, and the spin tub 22 is separated from the water tub 21.

In Step S 204, the balancer 23 is separated from the spin tub 22. In Step S 205, the motor 40 and the drain valve 50 are removed from the water tub 21.

After the breaking-up work, materials are retrieved from the component parts. Polypropylene resin is retrieved from the top cover 11 and the rear panel 16. From the parts unit 83, iron, copper and aluminum are retrieved by magnetic sorting and static electricity screening after crushing. The combination of operation control panel 14 and the operation control unit 80, which contains lead and copper, is processed in a lead-smelting furnace and a copper-smelting furnace to retrieve lead and copper. From the spin tub 22, stainless steel and synthetic resin such as polypropylene are retrieved. From the balancer 23, salt water (mass for balancing) is extracted and synthetic resins, polypropylene for example, are retrieved. From the water tub 21, synthetic resins, polypropylene for example, are retrieved. The motor is disassembled and iron, copper, aluminum and other materials are retrieved. From the housing 10, iron and synthetic resin are retrieved.

The time required for taking out the circuit boards and parts from the top cover of the washing machine 1 in the present embodiment was worked out using said DFE software. For comparison, the washing machine with the rear-portion parts directly fixed on the top cover without a base was evaluated.

Figure 32:
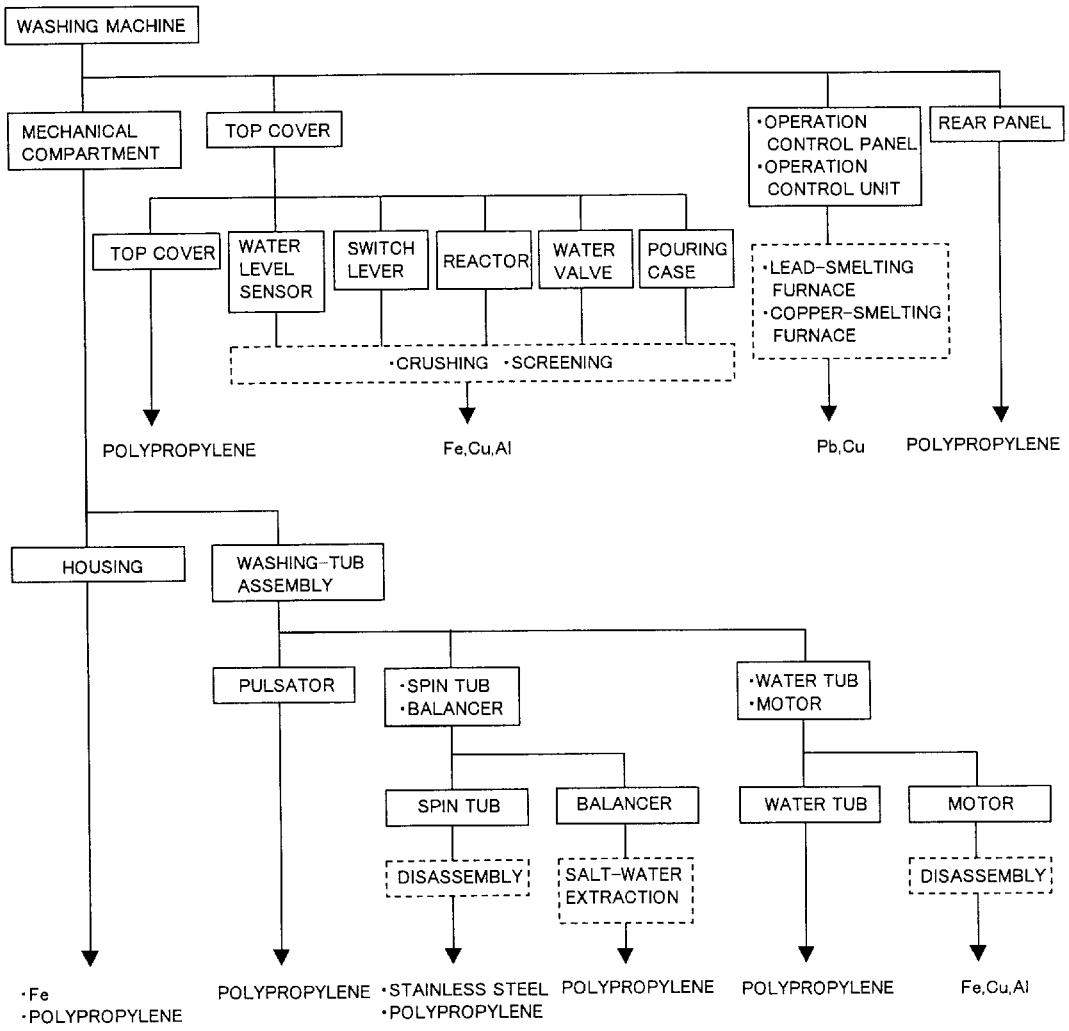
FIG. 32 is a flow chart of breaking up, similar to FIG. 25, which is used in breaking up the washing machine of the prior art construction.

FIG. 32 shows the breaking-up procedure for the comparative example. In the washing machine of the comparative example, it took 140 seconds to r(move the operation control unit, rear parts etc. from the top cover. Especially in removing the rear-portion parts, it took long to remove four screws used to fix the reactor, pouring case etc. and snap fits that fixed individual parts like level sensor, switch lever etc.

In the washing machine 1 of the present embodiment, it took only 50 seconds to remove the control circuit board, inverter circuit board and rear parts—90 seconds shorter than the time required for the prior art washing machine.

The polypropylene of the broken-up top cover can be recycled. If, for example, the weight of the top cover is 1.2 kg and that of the washing machine is 46.5 kg, it contributes to an improvement in the recycle percentage of the washing machine by some 2.6%.

According to the present invention as shown, the parts disposed in the rear portion of the top cover can be removed from the top cover in the form of parts unit in a lump, and it is possible to recycle the synthetic resins of the top cover without much increasing the breaking up time. It is also noted that the top cover can be recycled and the recycle percentage can be improved, because the top cover has no foreign materials with it.

Furthermore, the top cover, parts unit, and rear panel are fixed on the housing of the washing machine by common screws. By merely removing those screws, it is possible to disassemble the rear panel, parts unit and top cover. And when, the screws fixing the operation. control panel and the top cover to the housing, too, are removed, the top cover can be separated from the mechanical compartment of the washing machine without difficulty. Then, the mechanical compartment is broken up, and such parts as housing, water tub, spin tub and motor are singled out one by one. Those parts can be recycled in techniques suitable for respective component parts.

What is claimed is:

1. A washing machine comprising:

(a) a box-like housing, (b) a top cover provided at an upper portion of said housing, (c) a front portion of said top cover being provided with an operation panel and an operation control unit, (d) a rear portion of said top cover being provided with a parts unit having a base on which at least a water valve and a pouring case are mounted and a rear panel to cover said parts unit.

2. A washing machine as claimed in claim 1, wherein said top cover and said parts unit are united with each other by engaging claws, and the top cover, parts unit and rear panel are fixed on the housing with common screws.

* * * * *